US010337512B2

(12) United States Patent
Lewis et al.

(10) Patent No.: US 10,337,512 B2
(45) Date of Patent: Jul. 2, 2019

(54) GEAR PUMP WITH DUAL PRESSURE RELIEF

(71) Applicant: Carrier Corporation, Jupiter, FL (US)

(72) Inventors: Russell G. Lewis, Manlius, NY (US); James S. Brissenden, Baldwinsville, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 131 days.

(21) Appl. No.: 15/502,584

(22) PCT Filed: Aug. 25, 2015

(86) PCT No.: PCT/US2015/046654

§ 371 (c)(1),
(2) Date: Feb. 8, 2017

(87) PCT Pub. No.: WO2016/033015

PCT Pub. Date: Mar. 3, 2016

(65) Prior Publication Data

US 2017/0227006 A1 Aug. 10, 2017

Related U.S. Application Data

(60) Provisional application No. 62/041,514, filed on Aug. 25, 2014.

(51) Int. Cl.
*F03C 4/00* (2006.01)
*F04C 18/00* (2006.01)
(Continued)

(52) U.S. Cl.
CPC ..... *F04C 14/26* (2013.01); *F04C 2/084* (2013.01); *F04C 2/10* (2013.01); *F04C 2/102* (2013.01);
(Continued)

(58) Field of Classification Search
CPC .. F04B 53/18; F04C 2/084; F04C 2/10; F04C 2/102; F04C 14/265; F04C 14/26;
(Continued)

(56) References Cited

U.S. PATENT DOCUMENTS 3,303,784 A 2/1967 Neubauer
3,343,494 A * 9/1967 Erikson ..... F04C 2/102 418/171
(Continued)

FOREIGN PATENT DOCUMENTS

CN 202100456 U 1/2012
CN 103174644 A 6/2013
(Continued)

OTHER PUBLICATIONS

International Search Report and Written Opinion dated Jan. 26, 2016 for PCT/US2015/046654.
(Continued)

*Primary Examiner* — Theresa Trieu
(74) *Attorney, Agent, or Firm* — Bachman & LaPointe, P.C.

(57) ABSTRACT

An internal gear pump (100) comprises: a rotor/torque ring comprising an internally lobed (140) rotor (130) and a torque ring (120) extending beyond at least a first end (134) of the rotor; an externally lobed (160) idler (150) encircled by the rotor; a hollow shaft (190) supporting the idler; a pressure relief element (200) positioned to shift between a first condition and a second condition; and a spring (210) biasing the pressure relief element toward the first condition from the second condition. The torque ring has at least one pressure relief port (240A, 240B) positioned so that: in the first condition, the pressure relief element blocks a path from an interior volume (235) of the pump to the pressure relief
(Continued)

port; and in the second condition, relative to the first condition the pressure relief element does not block the path.

18 Claims, 12 Drawing Sheets

(51) Int. Cl.

| | |
|---|---|
| ***F04C 2/00*** | (2006.01) |
| ***F04C 14/26*** | (2006.01) |
| ***F04C 2/10*** | (2006.01) |
| ***F04C 2/08*** | (2006.01) |
| ***F04C 13/00*** | (2006.01) |
| ***F04C 15/00*** | (2006.01) |
| *F04B 53/18* | (2006.01) |

(52) U.S. Cl.
CPC ..... *F04C 13/001* (2013.01); *F04C 14/265* (2013.01); *F04C 15/0007* (2013.01); *F04B 53/18* (2013.01)

(58) Field of Classification Search
CPC ..... F04C 15/0007; F04C 15/0019; F04C 15/0023; F04C 15/0026; F04C 15/003; F04C 15/0042; F04C 13/001; F04C 29/023; F04C 29/025; F04C 2240/809; F01C 21/108
USPC ..... 418/1, 166, 171, 131–135
See application file for complete search history.

(56) References Cited

U.S. PATENT DOCUMENTS

| | | | | |
|---|---|---|---|---|
| 3,655,299 | A * | 4/1972 | Connelly | F04C 14/265 417/310 |
| 4,160,630 | A | 7/1979 | Wynn | |
| 4,932,841 | A | 6/1990 | Havemann | |
| 5,346,375 | A | 9/1994 | Akiyama et al. | |
| 6,132,177 | A | 10/2000 | Loprete et al. | |
| 6,273,695 | B1 | 8/2001 | Arbogast et al. | |
| 6,352,085 | B1 | 3/2002 | Morita et al. | |
| 6,739,850 | B2 | 5/2004 | Kawasaki et al. | |
| 7,401,593 | B2 | 7/2008 | Rembold et al. | |
| 8,667,983 | B2 | 3/2014 | Min et al. | |
| 2003/0026711 | A1 | 2/2003 | Bodzak | |
| 2005/0214154 | A1* | 9/2005 | Morita | F04C 15/0026 418/134 |
| 2009/0196772 | A1* | 8/2009 | Watanabe | F04B 49/00 417/213 |
| 2012/0003081 | A1 | 1/2012 | Woollenweber | |
| 2012/0312160 | A1 | 12/2012 | Middleton et al. | |
| 2013/0164162 | A1 | 6/2013 | Saga | |
| 2013/0164163 | A1 | 6/2013 | Ohnishi et al. | |
| 2014/0017100 | A1 | 1/2014 | Sato et al. | |

FOREIGN PATENT DOCUMENTS

| | | | |
|---|---|---|---|
| CN | 103174645 | A | 6/2013 |
| EP | 0083491 | A1 | 7/1983 |
| EP | 1311762 | B1 | 9/2006 |
| JP | 2000291565 | A | 10/2000 |
| WO | 2011/158167 | A2 | 12/2011 |
| WO | 2012/097440 | A1 | 7/2012 |

OTHER PUBLICATIONS

Tech Training Diagram: "06D Semi-Hermetic Compressor", Feb. 2004, Carrier Corporation, Jupiter, Florida.
"Engineering Data Pack TR Series Pump", Nov. 14, 2013, Tuthill Pump Group, Alsip, Illinois.
Chinese Office Action dated May 3, 2018 for Chinese Patent Application No. 201580045856.3.

* cited by examiner

GEAR PUMP WITH DUAL PRESSURE RELIEF

CROSS-REFERENCE TO RELATED APPLICATION

Benefit is claimed of U.S. Patent Application No. 62/041,514, filed Aug. 25, 2014, and entitled "Gear Pump with Dual Pressure Relief", the disclosure of which is incorporated by reference herein in its entirety as if set forth at length.

BACKGROUND

The disclosure relates to pumps. More particularly, the disclosure relates to gear pumps used in compressor lubrication.

Compressors such as reciprocating compressors require lubrication. An exemplary reciprocating compressor can require lubrication at one or more of several locations. These locations include main bearings supporting a shaft relative to the case. For reciprocating compressors, the shaft is a crankshaft and the locations further include: bearings between the crankshaft and rods; wrist bearings of the rods/pistons; and the piston/cylinder interfaces. Oil may be delivered through passageways in the shaft. An oil pump may be mounted to be driven by the shaft to draw oil from a compressor sump and drive it through the passageways.

An exemplary pump is sold as the "TR Series Pump" by Tuthill Pump Group of Alsip, Ill., US. Such pump has an externally lobed idler (inner gerotor gear) mounted within an internally-lobed rotor (outer gerotor gear). The rotor is a portion of a rotor/torque ring assembly. The torque ring comprises a sleeve within which the rotor is secured (e.g., by welding, interference fit, or the like). As is discussed below, the torque ring drives rotation of the rotor and, via the rotor rotation of the idler.

Respective first and second end portions of the torque ring protrude beyond opposite first and second ends of the rotor. The first end portion is a proximal end portion and mounts to the crankshaft to be rotated about the crank axis. The first end portion also floating plate or washer that serves as a pressure relief valve element. The washer is biased by a spring into sealing engagement with the first ends of the rotor and idler. A forward portion of the spring may be in a sealing sleeve slidingly mounted in the spring compartment of the crankshaft.

The second end portion contains a carrier assembly that comprises a hollow axle on which the idler rides. The axle has an axis parallel to and slightly offset from the crank axis. The carrier assembly has an end plate from which the axle protrudes. The end plate is mounted to the second end portion of the rotor/torque ring.

The exemplary pump is an automatic reversing pump that provides flow in on flow direction regardless of the direction of shaft rotation. This is achieved by providing the end plate with a pair of ports that interact with a pair of ports of a pump cover. The pump cover ports are a respective inlet port and outlet port. The cover inlet port is in communication with an oil pickup line extending to an inlet (e.g., at a strainer in the compressor sump). The cover outlet port is in communication with a bore of the axle to pass flow through passageways in the crankshaft to bearings.

As rotation of the ring drives rotation of the idler pockets formed between their lobes will sequentially be open to the two cover ports via the two carrier ports. The pockets will open to the cover inlet port, expand to draw liquid in from the cover inlet port, close to the cover inlet port and open to the cover outlet port, contract so as to discharge liquid through the cover outlet port, and then close to the cover outlet port and open to the cover inlet port to complete the cycle, If pressure in the pocket becomes sufficient to overcome the spring bias, the pressure will shift the washer out of sealing contact with the ends of the idler and rotor and open up a pathway for fluid to pass back through the cover inlet to relieve pressure.

SUMMARY

One aspect of the disclosure involves an internal gear pump comprising: a rotor/torque ring comprising an internally lobed rotor and a torque ring extending beyond at least a first end of the rotor; an externally lobed idler encircled by the rotor; a hollow shaft supporting the idler; a pressure relief element positioned to shift between a first condition and a second condition; and a spring biasing the pressure relief element toward the first condition from the second condition. The torque ring has at least one pressure relief port positioned so that: in the first condition, the pressure relief element blocks a path from an interior volume of the pump to the pressure relief port; and in the second condition, relative to the first condition the pressure relief element does not block the path.

In one or more embodiments of any of the foregoing embodiments, the at least one pressure relief port has an axial span ($D_H$) greater than a thickness of an adjacent surface of the pressure relief element.

In one or more embodiments of any of the foregoing embodiments, the at least one pressure relief port comprises a pair of pressure relief ports.

In one or more embodiments of any of the foregoing embodiments, the at least one pressure relief port comprises a through-hole between an inner diameter (ID) surface of the torque ring and an outer diameter (OD) surface of the torque ring.

In one or more embodiments of any of the foregoing embodiments, the pump further comprises a carrier from which the hollow shaft protrudes and having a pair of ports.

In one or more embodiments of any of the foregoing embodiments, the pump further comprises a sealing sleeve having: a shoulder positioned to contact the pressure relief element; and a sidewall extending from the shoulder and surrounding a portion of the spring.

In one or more embodiments of any of the foregoing embodiments, the torque ring further comprises a pair of driving slots for receiving driving pins protruding from a driveshaft received in the torque ring first end portion.

In one or more embodiments of any of the foregoing embodiments, a compressor comprises the pump and further comprises: a housing; a driveshaft carried by the housing for rotation about an axis and to which the torque ring is mounted; and one or more working elements coupled to the driveshaft to be driven by said rotation of the driveshaft.

In one or more embodiments of any of the foregoing embodiments: the driveshaft is a crankshaft; the one or more working elements are one or more pistons coupled to the crankshaft by associated connecting rods; and an oil passageway extends through the crankshaft from the pump to an interface between the crankshaft and the connecting rods.

In one or more embodiments of any of the foregoing embodiments, a lubrication flowpath proceeds sequentially: from a pickup in a sump of the compressor; through a carrier carrying the shaft and into an internal volume of the pump;

from the internal volume of the pump back through the carrier; and through the hollow shaft and into the driveshaft.

In one or more embodiments of any of the foregoing embodiments, a relief flowpath proceeds sequentially: through the at least one pressure relief port into a pump cavity of the housing; and through a drain passageway to a sump of the compressor.

In one or more embodiments of any of the foregoing embodiments, a pair of pins protrude from the driveshaft into respective slots in the torque ring to rotationally couple the driveshaft to the rotor.

In one or more embodiments of any of the foregoing embodiments, the pump further comprises a sealing sleeve having: a shoulder positioned to contact the pressure relief element; and a sidewall extending from the shoulder and surrounding a portion of the spring.

In one or more embodiments of any of the foregoing embodiments, the driveshaft has a stepped compartment having: a first portion receiving the sealing sleeve sidewall; and a second portion receiving a proximal end portion of the spring.

In one or more embodiments of any of the foregoing embodiments, a method for using the pump comprises rotating the rotor. The rotating causes a pressure increase in the interior volume; and the pressure increase acting to shift the pressure relief element against said spring bias from the first condition to the second condition, the shift facilitating a pressure relief flow from the interior through the pressure relief port.

In one or more embodiments of any of the foregoing embodiments, said pressure relief flow is a second pressure relief flow in addition to a first pressure relief flow between portions of the internal space.

In one or more embodiments of any of the foregoing embodiments, the pump is in a compressor and the first pressure relief flow passes through a pump cover while the second pressure relief flow bypasses the pump cover.

In one or more embodiments of any of the foregoing embodiments, a method for manufacturing the pump comprises starting with a baseline pump and drilling the at least one pressure relief port.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
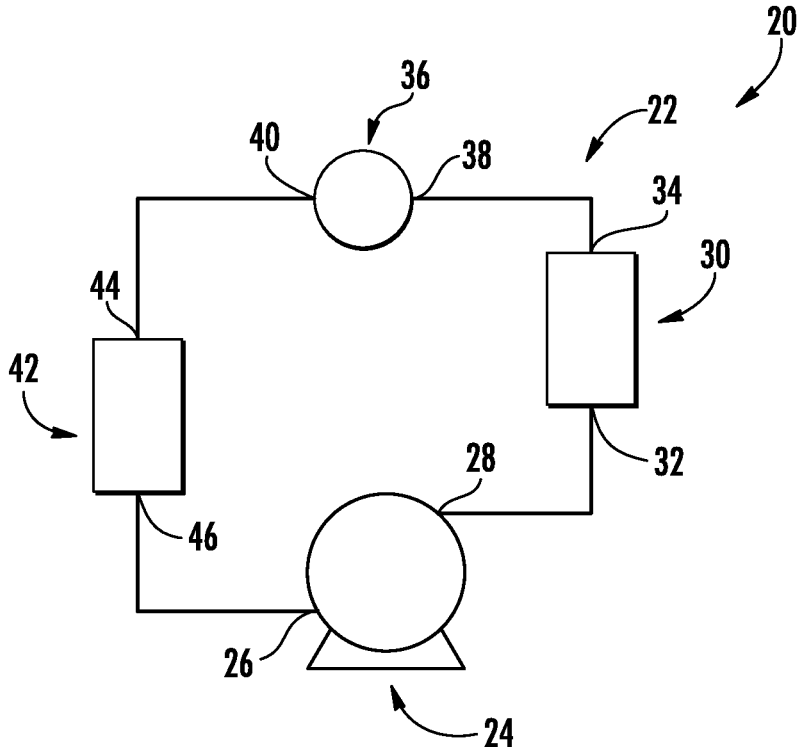
FIG. 1 (PRIOR ART)
FIG. 1 is a schematic view of a vapor compression system.

FIG. 1 shows a basic exemplary vapor compression system (refrigeration system) 20. The system includes components located along a recirculating refrigerant flowpath 22. The components include a compressor 24 having a suction port (inlet) 26 and a discharge port (outlet) 28. Downstream of the discharge port 28 along the refrigerant flowpath 22 is a heat exchanger 30 having an inlet 32 and an outlet 34. Downstream of the heat exchanger 30 is an expansion device 36 having an inlet 38 and an outlet 40. Downstream of the expansion device is a heat exchanger 42 having an inlet 44 and an outlet 46. From the heat exchanger 42, the flowpath 22 returns to the suction port 26.

Various conduits (e.g., tubes) may interconnect the various components along the flowpath 22. In a basic first mode of operation, the refrigerant is driven downstream along the flowpath 22 by the compressor 24 so that the heat exchanger 30 is a heat rejection heat exchanger rejecting heat from the compressed refrigerant. Depending upon refrigerant composition and operating parameters, the heat rejection heat exchanger may be termed a condenser or a gas cooler. After rejecting heat in the heat exchanger 30, the refrigerant passes to the expansion device 36 (e.g., an electronic expansion valve (EXV) or a thermal expansion valve (TXE)) where it is expanded to reduce temperature. The reduced temperature refrigerant then passes through the heat exchanger 42 which serves as a heat absorption heat exchanger absorbing heat from the refrigerant prior to returning that refrigerant to the compressor. The heat exchanger 42 may serve as an evaporator in this mode. More complicated circuits including additional components may be possible as may be more complicated operations (e.g., including various modes for different environmental conditions).

Depending upon the nature of the system 20 (e.g., a chiller versus some other system) the heat exchangers may be refrigerant-air heat exchangers, refrigerant-water heat exchangers, or the like.

Figure 2:
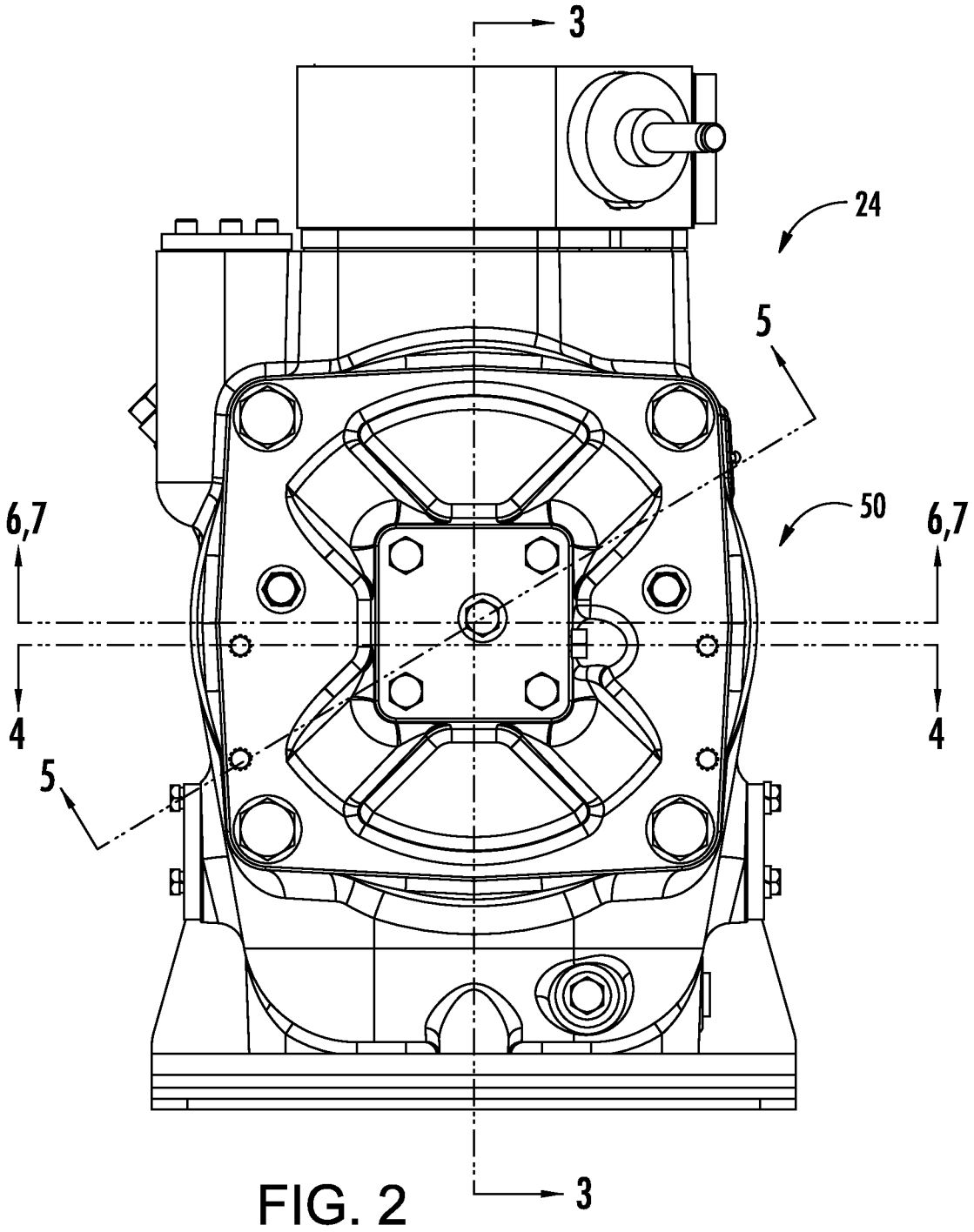
FIG. 2 is a front view of a compressor of the system of FIG. 1.
Figure 3:
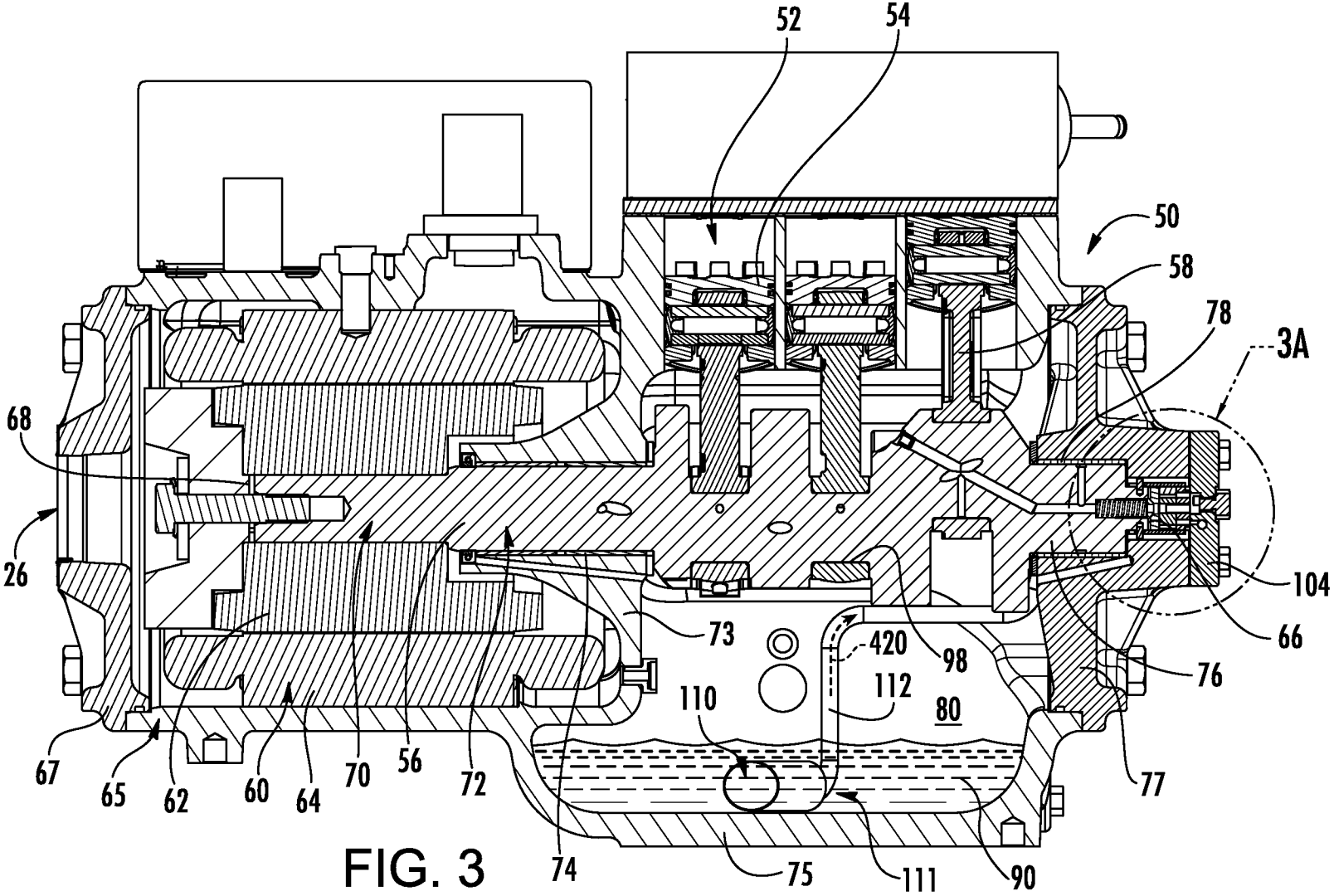
FIG. 3 is a longitudinal sectional view of the compressor taken along line 3-3 of FIG. 2.

The exemplary compressor 24 is a reciprocating compressor having a case or housing assembly 50 (FIGS. 2 and 3) defining a plurality of cylinders 52 each of which receives a respective piston 54. The pistons are coupled to a shaft (crankshaft) 56 by associated connecting rods 58. The exemplary compressor has an integral motor comprising a rotor 62 and a stator 64 within a motor case portion 65 of the housing. This is discussed below, the exemplary case assembly comprises a main casting forming a crankcase, cylinders, the motor case portion 65, and a wall therebetween. The exemplary compressor inlet 26 is formed along a motor coverplate 67 at a rear end of the housing assembly 50. Alternative configurations of reciprocating compressor are possible as are alternative compressor configurations generally (e.g., having working elements other than pistons).

Figure 3A:
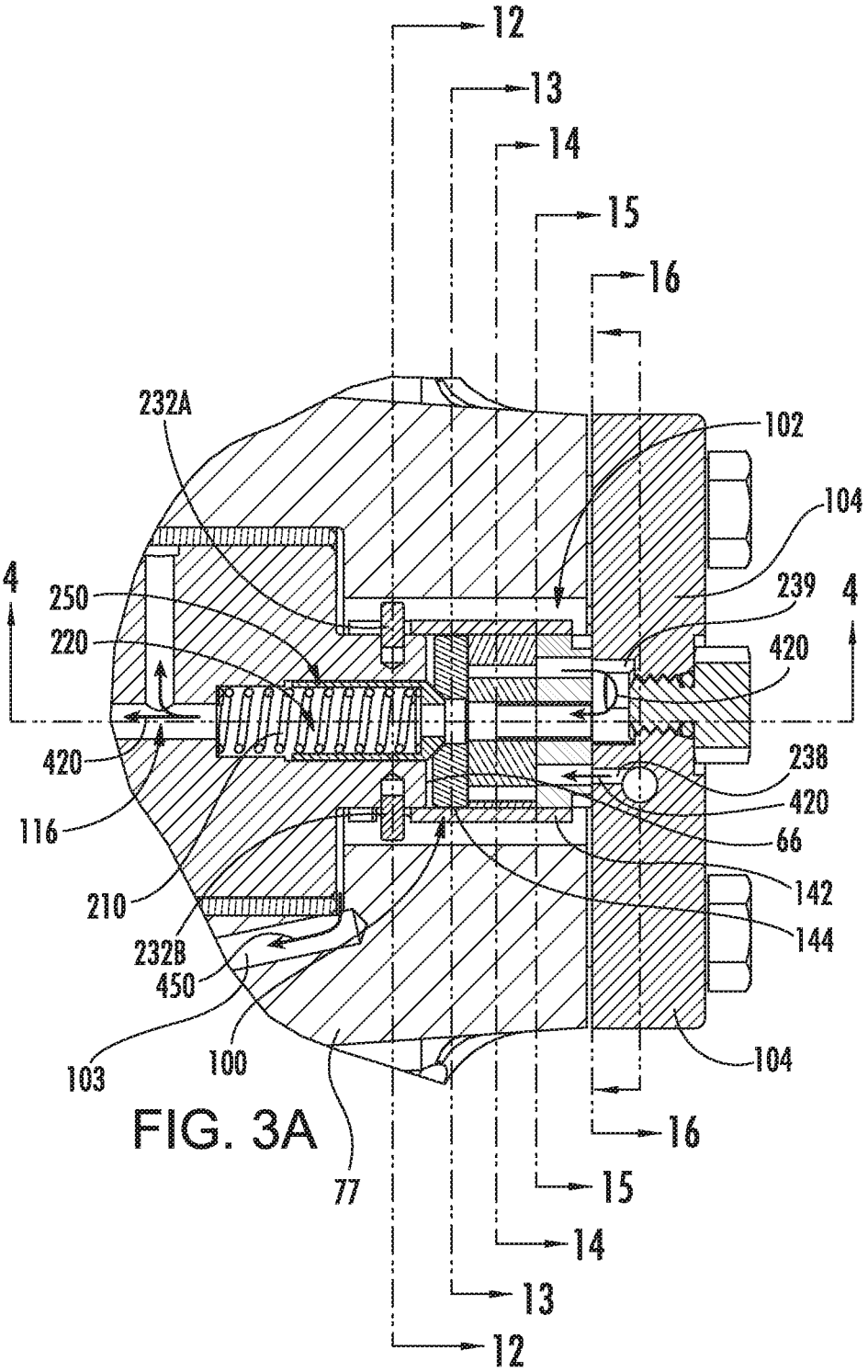
FIG. 3A is an enlarged view of a pump region of the compressor of FIG. 3.

The shaft 56 extends from a forward end 66 to a rear end 68. The shaft 56 is mounted to the housing assembly for rotation about a shaft axis 500 by a plurality of main bearings. The shaft 56 has a rear portion 70 received within the motor rotor 62. A crankshaft intermediate portion 72 is mounted within a bearing 74 in a wall 73 between the motor case and a crankcase portion 75 of the housing. The crankcase defines a sump 80. A crankshaft forward portion 76 is received within a bearing 78 in a pump housing 77 at the forward end of the case assembly. FIG. 3A shows the oil pump 100 within the pump case. The exemplary oil pump, as discussed above, is based upon the existing "TR Series Pump". The pump 100 is within a compartment 102. The forward end of the pump housing is closed by a pump cover 104.

Figure 4:
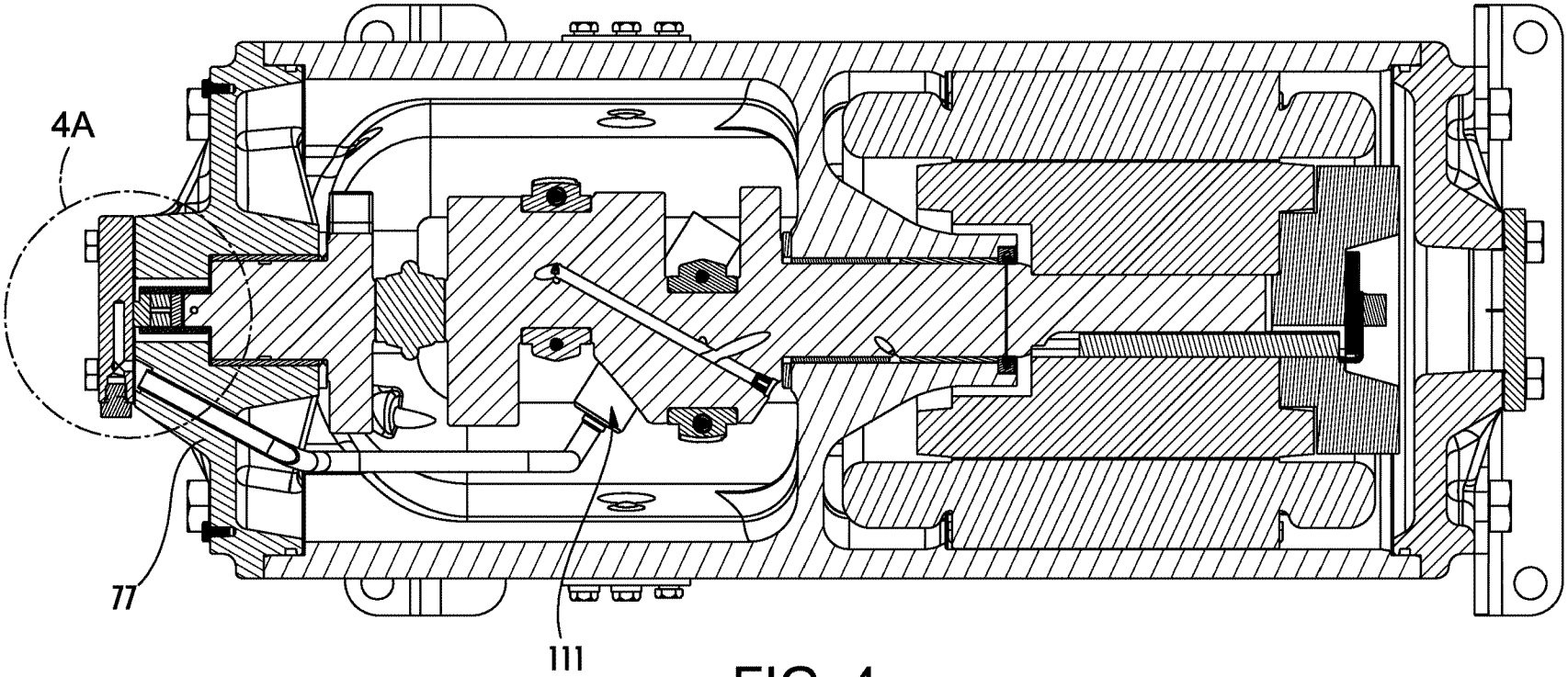
FIG. 4 is a longitudinal sectional view of the compressor taken along line 4-4 of FIG. 2.
Figure 4A:
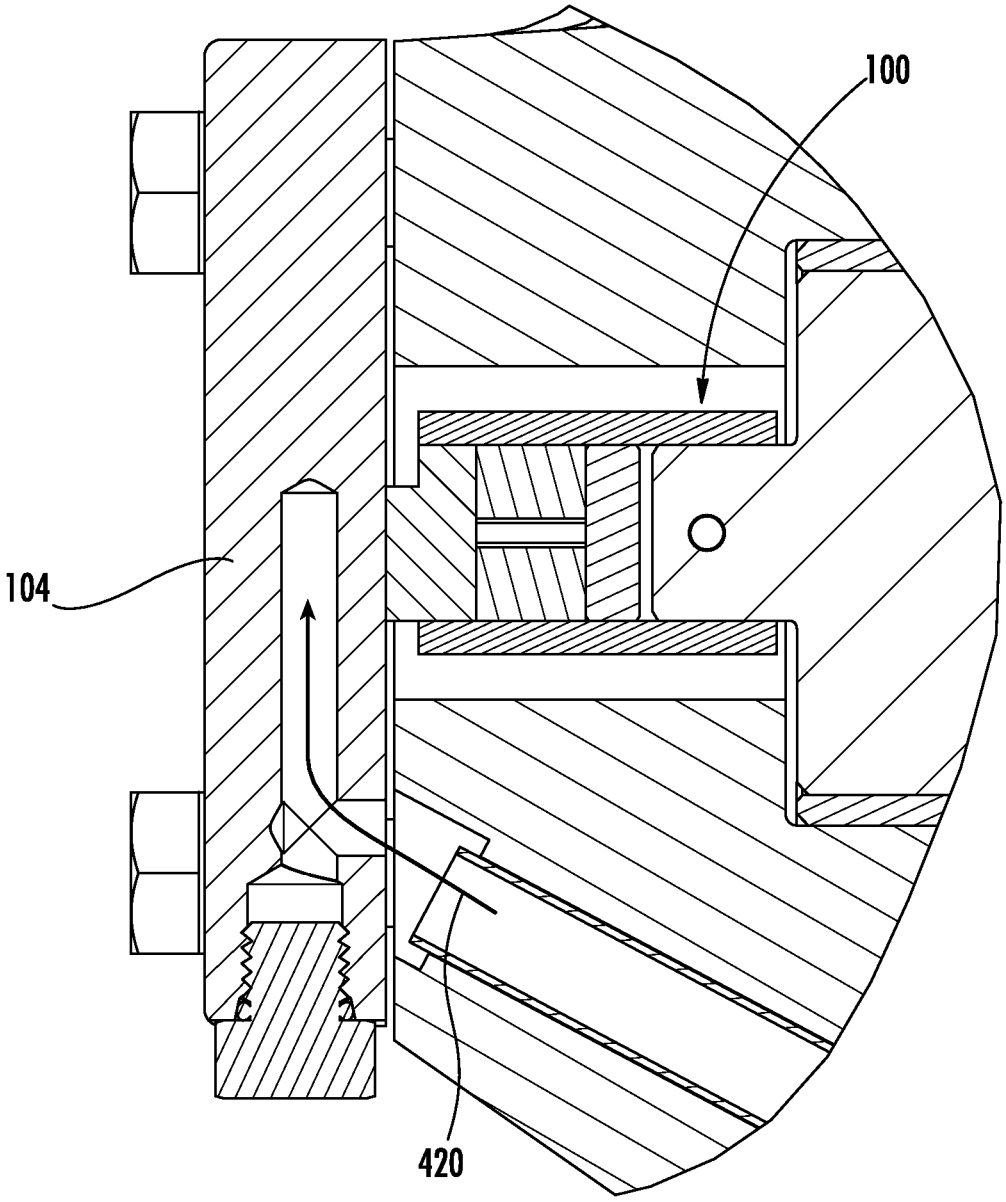
FIG. 4A is an enlarged view of the pump region of the compressor of FIG. 4.

In normal operation, the pump 100 drives a flow 420 of oil along an oil flowpath starting at an inlet 110 (FIG. 3) of a pickup/filter unit 111 in an oil accumulation 90 in the sump, passing through a conduit 112 to the pump housing 77 (FIG. 4), through the pump housing to the pump cover 104 (FIG. 4A). As is discussed further below, in normal operation, the oil flowpath proceeds into the pump (FIG. 3A), back out of the pump into the pump cover and then back through the pump into the shaft 56. FIG. 3A shows a passageway 116 in the shaft 56 which includes a trunk feeding branches with the branches extending to the main bearings 74, 78 and to bearings 98 interfacing with the connecting rods.

FIGS. 8-15 show further details of the exemplary pump 100. The pump has a central longitudinal axis 500 which is coincident with the crankshaft axis 500 when installed. The torque ring 120 is formed as a sleeve extending from a first end 122 to a second end 124 and having an inner diameter (ID) or inner surface 126 and an outer diameter (OD) or outer surface 128. The rotor 130 (FIG. 10) extends from first end 132 to a second end 134 and has an inner surface 136 and an outer surface 138. The inner surface is formed by a plurality of lobes 140. The rotor is fixed in the torque ring such as by interference fit (e.g., thermal interference fit), welding, or the like to create a rigid unit as the rotor/torque ring assembly. The torque ring has portions 142, 144 extending beyond the respective ends of the rotor. The idler 150 is received off-center within the rotor and thus has a central longitudinal axis 502 which is parallel to and offset from the axis 500. The idler 150 extends from a first end 152 to a second end 154. The idler has an inner surface 156 forming a bore 157. The idler has an outer surface 158 formed by lobes 160 which cooperate with the lobes of the rotor to provide the pumping action.

Figures 10, 11:
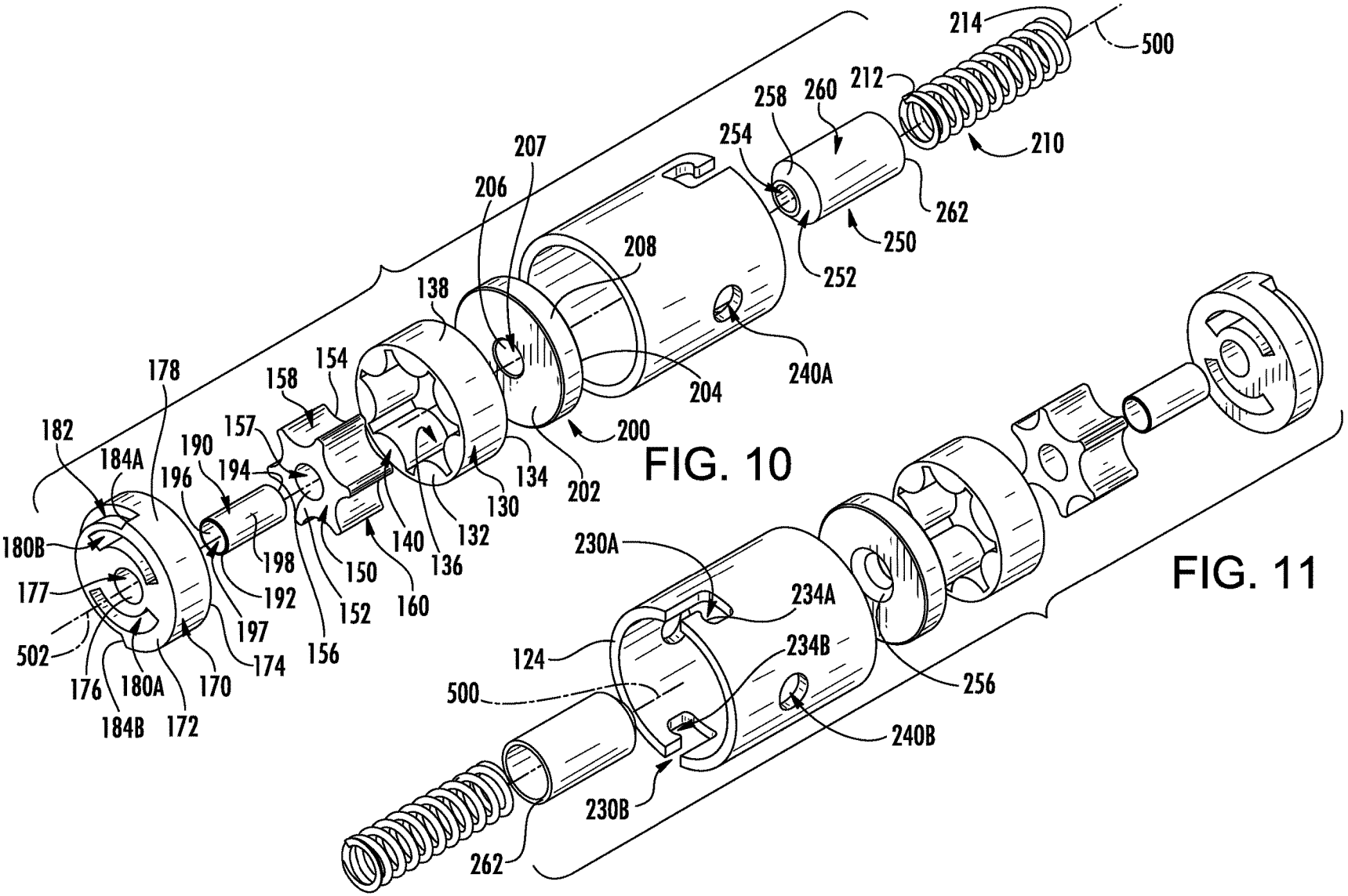
FIG. 10 is a first exploded view of the pump.
FIG. 11 is a second exploded view of the pump.

FIG. 10 also shows the pump 100 having a carrier (idler carrier) 170 extending from a first end 172 to a second end 174 and having an inner surface 176 and an outer surface 178. The inner surface 176 defines a bore 177 which is off-center relative to the outer surface and shares the axis 502.

Figure 12:
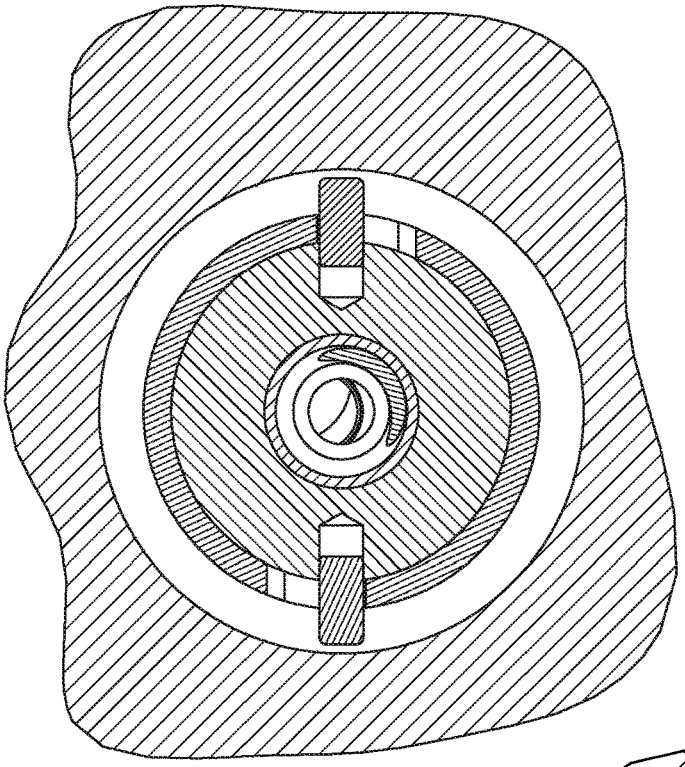
FIG. 12 is a partial transverse sectional view of the pump region taken along line 12-12 of FIG. 3A.
Figure 13:
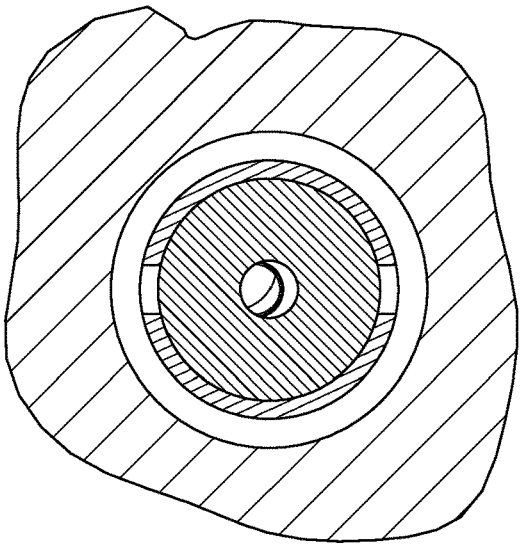
FIG. 13 is a partial transverse sectional view of the pump region taken along line 13-13 of FIG. 3A.
Figure 15:
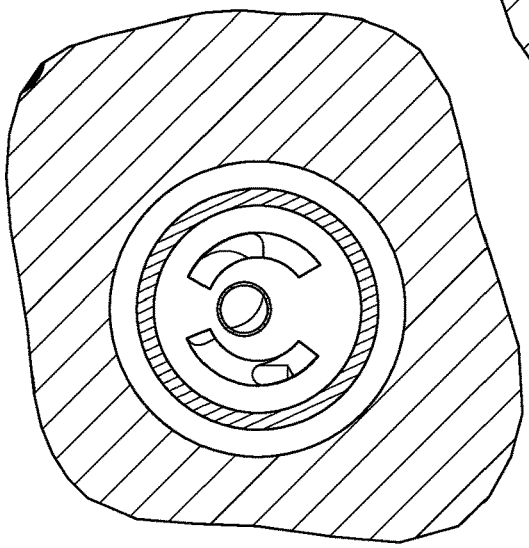
FIG. 15 is a partial transverse sectional view of the pump region taken along line 15-15 of FIG. 3A.

The carrier 170 comprises a pair of ports or passageways 180A, 180B (individually or collectively 180) extending between the ends 172 and 174. FIG. 12 also shows a partial shoulder 182 along a junction of the first end 172 and outer surface 178 extending circumferentially between a first end 184A and a second end 184B. As is discussed further below, the shoulder 182 and the passageways 180 are involved in providing a reversing action allowing the pump to operate regardless of in which direction the crankshaft is rotating.

FIG. 10 also shows an axle 190 received in the carrier bore 177 and idler bore 150 to allow the idler to rotate about the axis 502 parallel to and offset from the crankshaft axis 500.

The exemplary axle 190 is hollow (thus the axle 190 is a hollow axle or hollow shaft), extending from a first end 192 to a second end 194 and having an inner surface 196 (defining a passageway 197) and an outer surface 198.

FIG. 10 also shows a pressure relief element formed as a washer 200 having a first end 202, second end 204, an inner surface 206 (defining a bore or passageway 207), and an outer surface 208. In normal operation, the first surface 202 seals against the adjacent second ends (surfaces) 134 and 154 of the rotor and idler to seal off the associated ends of pockets formed between the rotor and idler.

FIG. 10 further shows a spring 210 for biasing the washer toward its sealing condition. The exemplary spring 210 is a metallic coil spring extending from a first longitudinal end 212 to a second longitudinal end 214. FIG. 3A shows the spring 210 in a compartment 220 at the forward end of the crankshaft compressed between the washer and a shoulder of the compartment. The compartment forms an inlet portion of the passageway system 116 within the crankshaft.

In the exemplary sealing condition, the front edge of the washer OD surface is slightly forward of the forward extremities of the ports. In the exemplary sealing condition, the rear edge of the sealing surface is forward of rear extremities of the ports. This would otherwise provide a leakage flow from the oil flow that has passed through the axle and washer. To prevent such leakage flow, the exemplary baseline pump has a sealing sleeve 250 (FIG. 10) or spring cover around a forward portion (distal portion) of the spring 210.

The sealing sleeve 250 has a shoulder or forward web 252 positioned to abut the rear face 204 of the washer. The shoulder has an aperture 254 for passing the oil flow. The washer may have an internal bevel/chamfer 256 (FIG. 11) between its bore/inner surface 206 and rear face that aligns the washer with a complementary external shoulder bevel/chamfer 258 of the shoulder. A sidewall 260 extends rearward from a periphery of the shoulder to a rim 262. To accommodate the sidewall, the spring compartment 220 is stepped (e.g., counter-bored) to create a relatively wide forward portion 270 accommodating the sidewall in sliding engagement and a narrower (smaller diameter) rear/base portion 272 accommodating a rear portion (proximal end portion) of the spring. Exemplary sealing sleeve material is machined metal such as stainless steel.

Returning to FIG. 11, the torque ring is seen having features 230A and 230B for mounting to the crankshaft. The exemplary features are bayonet fitting-style slots having a leg open to the end 124 and a circumferential leg extending to a terminus. The slots receive pins 232A, 232B protruding radially from an associated forward end portion of the crankshaft. Installation of the torque ring is via a translation followed by rotation followed by partial translation to detent the pins in terminal portions 234A; 234B of the slots. This detenting is biased by the spring 210 which pushes against the washer, to in turn push against the rotor.

Figure 16:
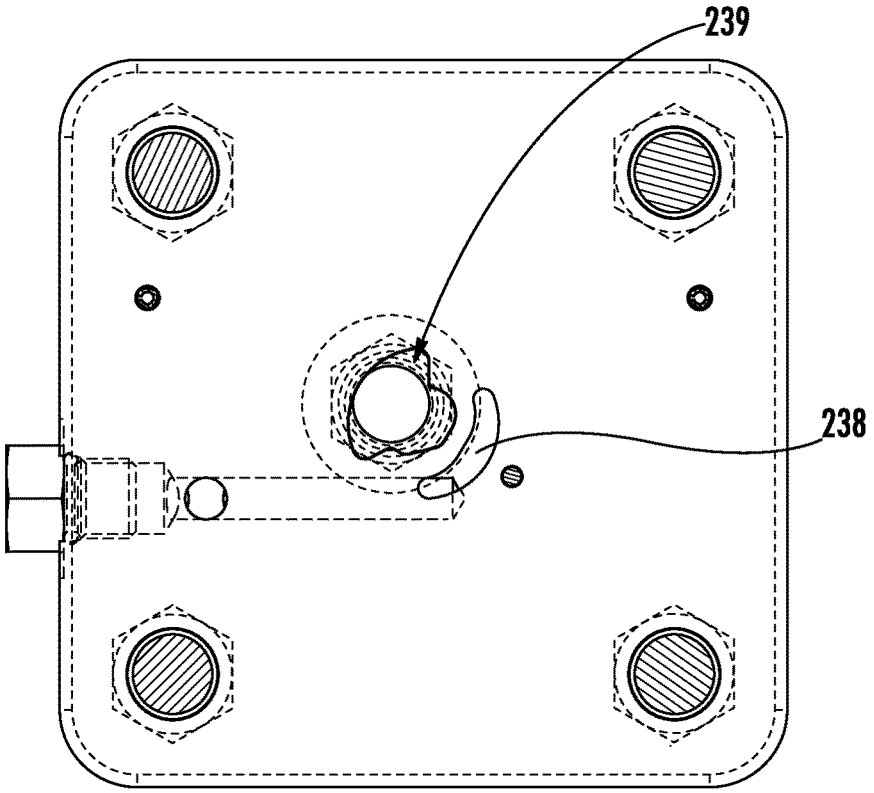
FIG. 16 is a rear end view of a pump cover.
Figure 14:
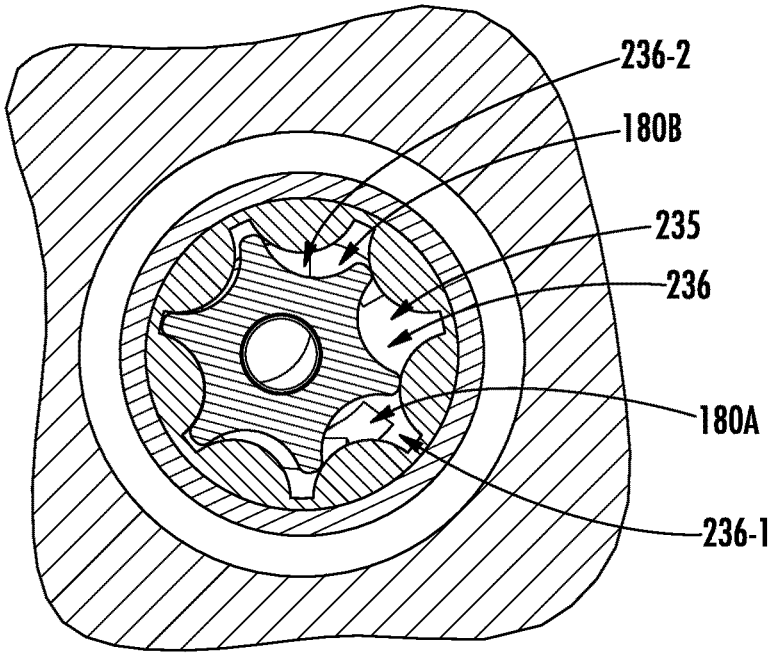
FIG. 14 is a partial transverse sectional view of the pump region taken along line 14-14 of FIG. 3A.

FIG. 14 shows an interior volume 235 of the pump between the external lobes of the idler and internal lobes of the rotor. The volume 235 may be formed by a circumferential group of pockets 236. FIG. 14 shows one of the pockets in a location shown as 236-1 aligned with the port 180A. The port 180A in this operational condition is aligned with and communicating with a port 238 (FIG. 16) in the rear face of the pump cover which delivers oil from the pickup. At a point where a pocket has rotated around to a location shown approximately as 236-2, oil flow from the pocket may pass axially forward to a relief 239 in the rear face of the pump cover and then back radially inward through the carrier and axle as shown in FIG. 3A.

Pressure in the pockets provides a rearward pressure/force against the washer front face which is resisted by the spring 210. However, an excessive pressure may overcome such bias and shift the washer rearward from its sealing condition engaging the rotor and idler to a pressure relief condition (e.g., to bottom out against the front end 66 of the shaft (FIG. 7)). In the baseline system, this allows a pressure equalization flow 440 leaving pressure in whichever pocket had excess pressure.

The exemplary embodiment adds an additional relief path for oil to pass from the pump. One or more ports 240A, 240B are provided in the torque ring positioned to be blocked from communication with the pocket by the washer when the washer is in its sealing position. However, a shift of the washer against the spring will immediately or eventually allow or increase communication between the pocket and the ports allowing a direct venting of oil out of the pump in addition to possible venting through the existing cover inlet or outlet ports.

Figure 7:
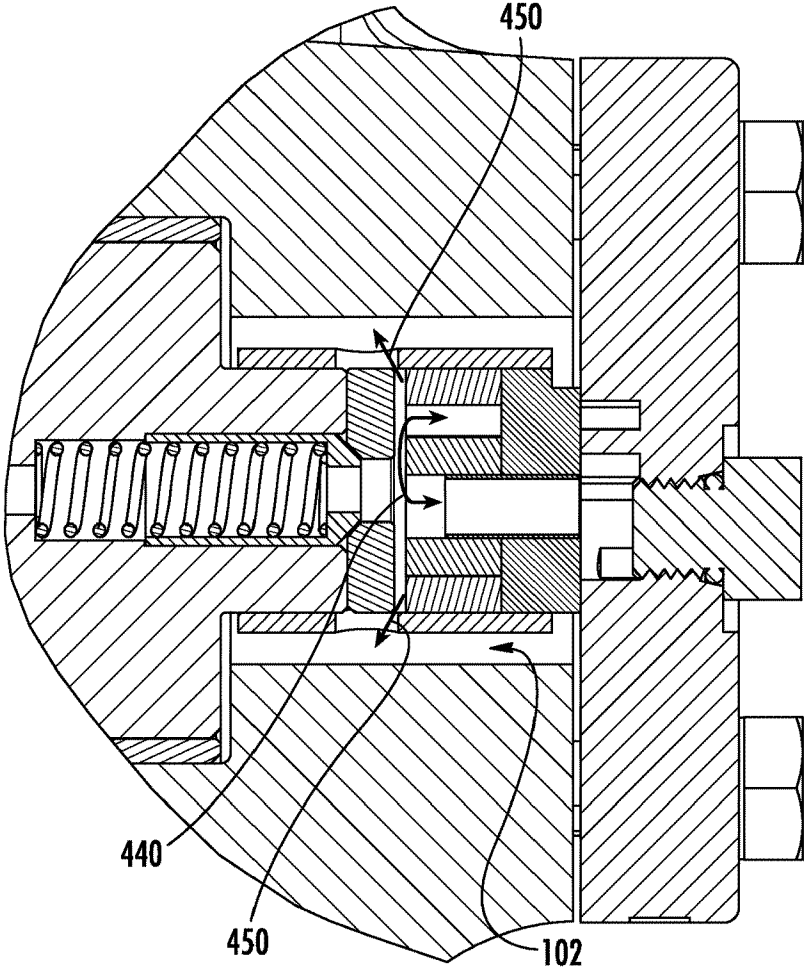
FIG. 7 is a longitudinal section view of the pump region during pressure relief taken along line 7-7 of FIG. 2.
Figure 6:
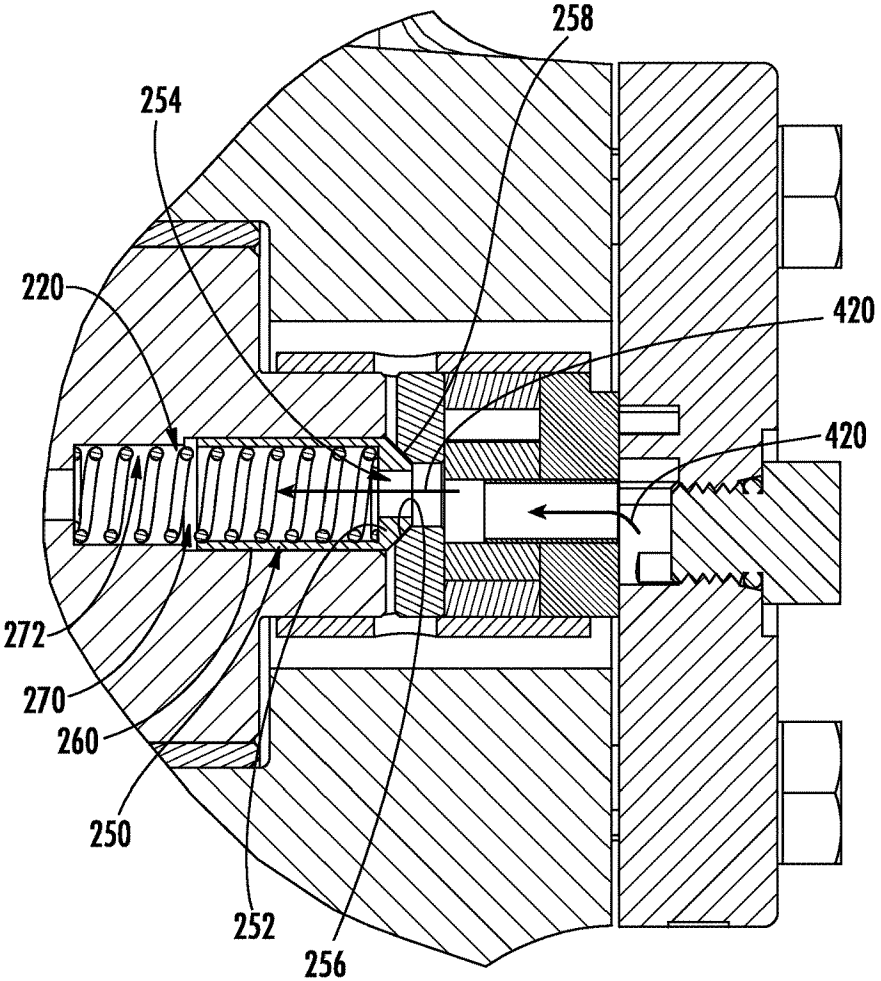
FIG. 6 is a longitudinal sectional view of the pump region taken along line 6-6 of FIG. 2.
Figure 8:
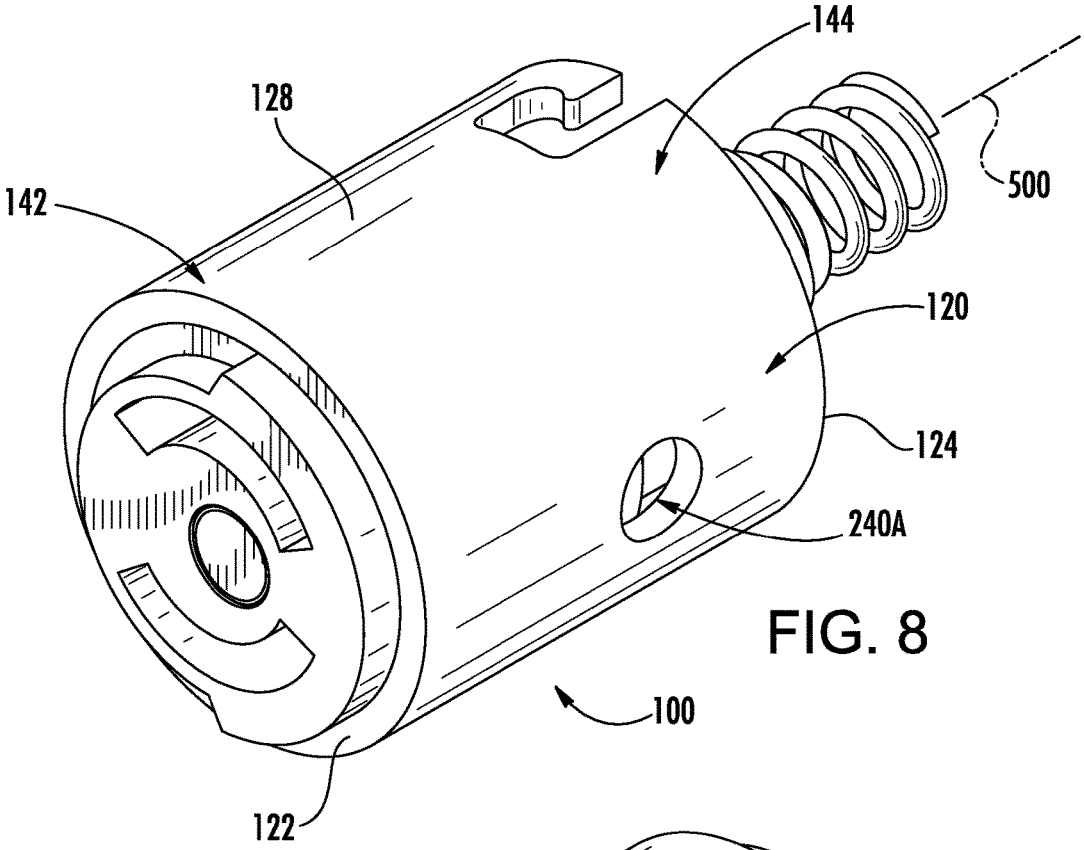
FIG. 8 is a first view of a pump.
Figure 9:
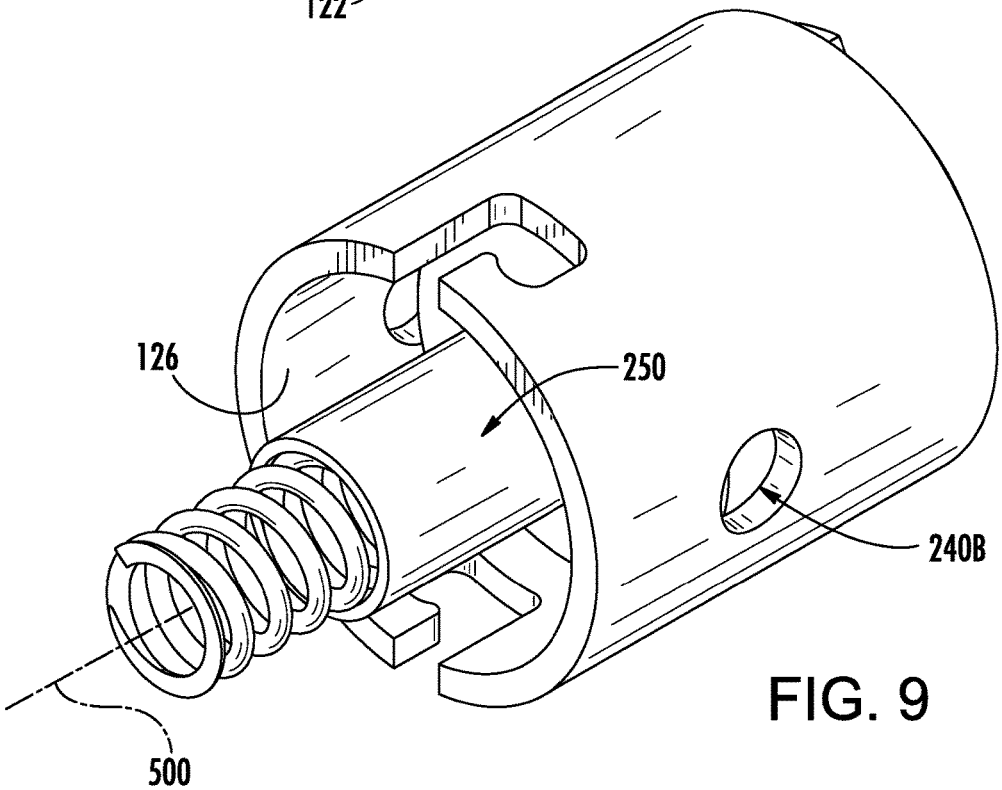
FIG. 9 is a second view of the pump.

In the exemplary embodiment, a pressure relief flow 450 is provided through the ports 240A and 240B because the shift of the washer from its initial sealing condition of FIG. 6 to its pressure relief condition of FIG. 7 exposes the pressure relief ports 240A, 240B to the interior volume to unblock a path from the interior volume to and through such pressure relief ports. The sealing sleeve shifts with the washer to block leakage behind the washer. The flow 450 may proceed into the pump compartment 102 surrounding the pump from which it may return to the sump 80 by a drain passageway 103 (FIG. 3A) in the pump housing. Thus, the flow 440 forms a first pressure relief flow passing through the pump cover 104 while the flow 450 forms a second pressure relief flow bypassing the pump cover.

Exemplary ports are radial circular holes (e.g., drilled). For such circular holes, exemplary diameters $D_M$ (and thus axial spans) are 0.25 inch (6.2 mm), more broadly, 2-10 mm or 4-8 mm. If non-circular, the holes may have similar cross-sectional areas to those circular holes. An exemplary number of holes is two, diametrically opposite each other. The holes are circular merely due to the convenience of drilling. Alternative holes might be formed by other cutting techniques.

In the exemplary sealing condition, the front edge of the washer OD surface is slightly forward of the forward extremities of the ports. In the exemplary sealing condition, the rear edge of the sealing surface is forward of rear extremities of the ports. For such a washer, an exemplary thickness at the outer diameter is 0.125 inch (3.2 mm), more broadly 30-80% of the axial span of the ports 240A and 240B.

Such a modification has been found to have several advantages. These and/or other advantages may or may not be present depending on the details of any particular implementation. These advantages may relate to uses in a broader range of conditions than a baseline pump provides desired performance in. One example involves non-refrigerant testing. Tests using air in the refrigerant flowpath have shown disparate performance. The exemplary pump may offer test performance closer to real world performance. Another example involves compressor capacity. Pump size is traditionally associated with compressor capacity. In one example pumps with idler/rotor lengths of one-half, three-eighths, and one-quarter inch lengths (12.7, 9.5, and 6.35 mm) are used for three different capacities of compressor in a given product line. A variable speed compressor is thus subject to a dilemma of pump size. Use of a larger length (e.g., the one-half inch (12.7 mm)) along with the pressure relief ports allows a single pump to be used on the different capacity compressors.

Figure 5:
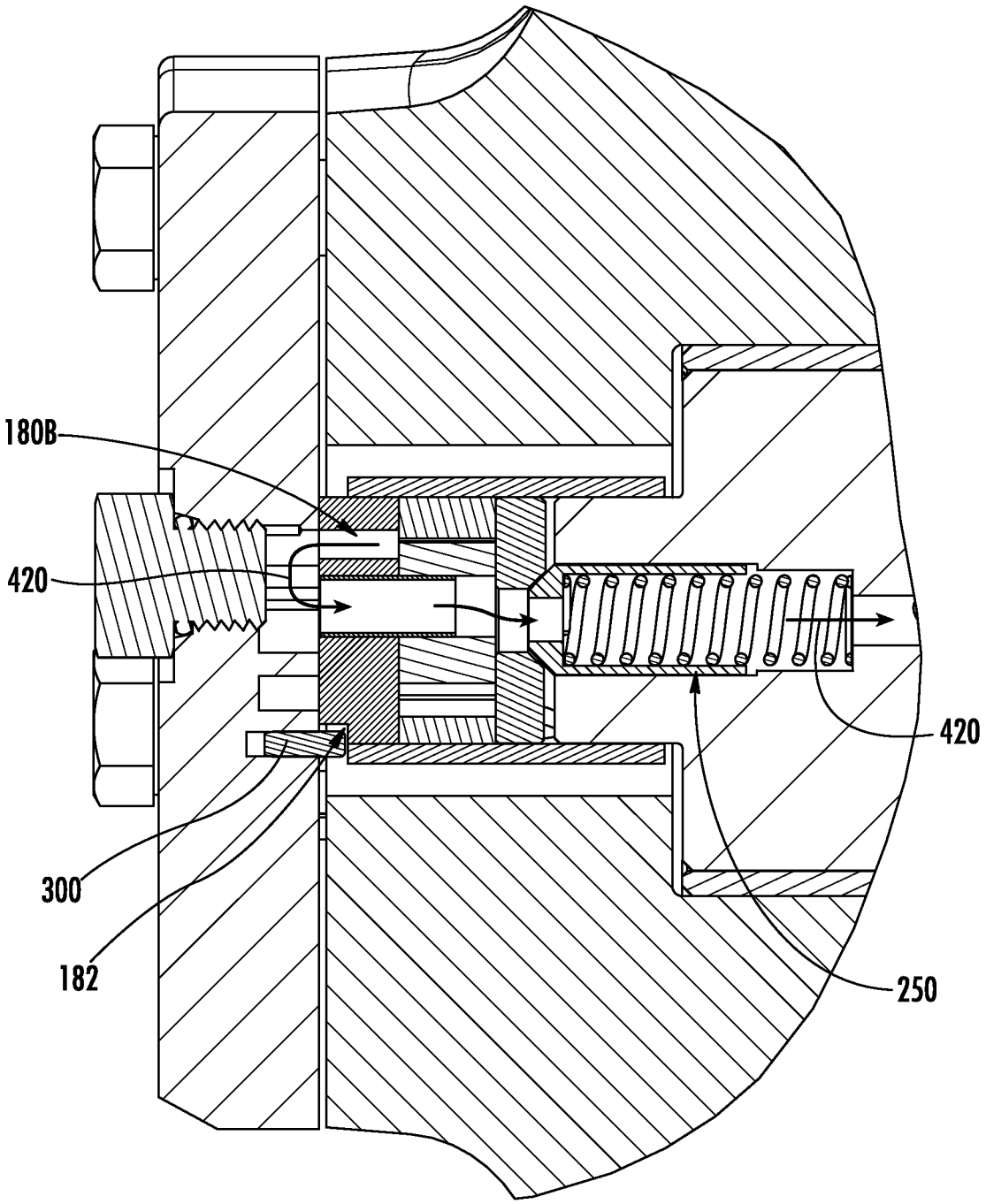
FIG. 5 is a longitudinal sectional view of the pump region of the compressor taken along line 5-5 of FIG. 2.

As was discussed above, the exemplary baseline pump provides a reversing action. This is facilitated by a pin 300 (FIG. 5) protruding from the rear face of the pump cover and received by the shoulder 182. Depending upon which direction the shaft rotates, a corresponding rotation will tend to be imparted to the carrier. Eventually, this will cause the pin 300 to abut one of the carrier shoulder ends 184A, 184B to stop further carrier rotation and thus determine which of the two ports 180A, 180B is positioned to pass oil inflow to the pump and which is positioned to pass flow back into the axle. In the exemplary illustrated condition, the port 180A passes the inflow and port 180B (FIG. 5) passes flow back through the pump cover into the axle. Reversing the direction of crankshaft rotation will rotate the carrier so that the pin abuts the other shoulder end to reverse the port functions.

Exemplary pump materials and manufacturing techniques may be the same as those used to form a hypothetical baseline pump such as the baseline mentioned above. The exemplary pump components are all metal such as steel (e.g., stainless steel).

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description. Similarly, the exemplary referenced directions merely establish a frame of reference and do not require any absolute orientation relative to a user. For example, the compressor front may well be at the rear of some larger system in which it is situated.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. An internal gear pump (100) comprising:

a rotor (130) fixed in a torque ring (120) comprising:

the rotor (130) having a plurality of internal lobes (140); and the torque ring (120) extending beyond at least a first end (134) of the rotor;

an idler (150) having a plurality of external lobes (160) encircled by the plurality of internal lobes (140) of the rotor;

a hollow shaft (190) supporting the idler;

a pressure relief element (200) positioned to shift between a first condition and a second condition; and a spring (210) biasing the pressure relief element toward the first condition from the second condition, wherein:

the torque ring (120) has at least one pressure relief port (240A, 240B) positioned so that:

in the first condition, the pressure relief element blocks a path from an interior volume (235) of the pump between the external lobes of the idler and the internal lobes of the rotor to the at least one pressure relief port; and in the second condition, relative to the first condition the pressure relief element does not block the path.

2. The pump of claim 1 wherein:

the at least one pressure relief port has an axial span ($D_H$) greater than a thickness of an adjacent surface of the pressure relief element.

3. The pump of claim 1 wherein:

the at least one pressure relief port comprises a pair of pressure relief ports.

4. The pump of claim 1 wherein:

the at least one pressure relief port comprises a through-hole between an inner diameter (ID) surface (126) of the torque ring and an outer diameter (OD) surface (128) of the torque ring.

5. The pump of claim 1 further comprising:

a carrier (170) from which the shaft protrudes and having a pair of ports (180A, 180B).

6. The pump of claim 1 further comprising a sealing sleeve having:

a shoulder positioned to contact the pressure relief element; and a sidewall extending from the shoulder and surrounding a portion of the spring.

7. The pump of claim 1 wherein the torque ring further comprises:

a pair of driving slots (230A, 230B) for receiving driving pins (232A, 232B) protruding from a drive shaft received in the torque ring first end portion.

8. A compressor (24) comprising the pump (100) of claim 1 and further comprising:

a housing (50);

a drive shaft (56) carried by the housing for rotation about an axis (500) and to which the torque ring is mounted; and one or more working elements (54) coupled to the driveshaft to be driven by said rotation of the driveshaft.

9. The compressor of claim 8 wherein:

the driveshaft is a crankshaft;

the one or more working elements are one or more pistons coupled to the crankshaft by associated connecting rods (58); and an oil passageway (116) extends through the crankshaft from the pump to an interface between the crankshaft and the connecting rods.

10. The compressor of claim 8 wherein a lubrication flowpath proceeds sequentially:

from a pickup (111) in a sump (80) of the compressor;

through a carrier (170) carrying the shaft and into an internal volume of the pump;

from the internal volume of the pump back through the carrier; and through the hollow shaft and into the driveshaft.

11. The compressor of claim 8 wherein a relief flowpath proceeds sequentially:

through the at least one pressure relief port into a pump cavity of the housing; and through a drain passageway to a sump of the compressor.

12. The compressor of claim 8 wherein:

a pair of pins (232A, 232B) protrude from the driveshaft into respective slots (230A, 230B) in the torque ring to rotationally couple the driveshaft to the rotor.

13. The compressor of claim 8 wherein the pump further comprises a sealing sleeve (250) having:

a shoulder (252) positioned to contact the pressure relief element; and a sidewall (260) extending from the shoulder and surrounding a portion of the spring.

14. The compressor of claim 13 wherein the shaft has a stepped compartment (220) having:

a first portion (270) receiving the sealing sleeve sidewall; and a second portion (272) receiving a proximal end portion of the spring.

15. A method for using the pump of claim 1, the method comprising:

rotating the rotor, the rotating causing a pressure increase in the interior volume; and the pressure increase acting to shift the pressure relief element against said spring bias from the first condition to the second condition, the shift facilitating a pressure relief flow from the interior through the pressure relief port.

16. The method of claim 15 wherein:

said pressure relief flow is a second pressure relief flow in addition to a first pressure relief flow between portions of the internal volume.

17. The method of claim 16 wherein the pump is in a compressor and the first pressure relief flow passes through a pump cover (104) while the second pressure relief flow bypasses the pump cover.

18. A method for manufacturing the pump of claim 1, the method comprising:

starting with a baseline pump and drilling the at least one pressure relief port.

* * * * *